United States Patent [19]

Kim

[11] 3,976,113

[45] Aug. 24, 1976

[54] CONVERTIBLE BLANKET ADAPTED TO FORM A TOTE BAG

[76] Inventor: Whan Jong Kim, 2175 Decoto Road, Apt. No. 125, Union City, Calif. 94587

[22] Filed: July 14, 1975

[21] Appl. No.: 595,861

[52] U.S. Cl. ..... 150/12; 5/344; 190/2

[51] Int. Cl.[2] ..... A45C 9/00

[58] Field of Search ..... 5/344; 190/2; 150/1.7, 150/12, 33, 52 R

[56] References Cited

UNITED STATES PATENTS

| | | | |
|---|---|---|---|
| 1,526,839 | 2/1925 | Dempsey | 150/52 R X |
| 1,953,962 | 4/1934 | Kinney | 150/12 |
| 2,447,940 | 8/1948 | Holland | 150/1.7 X |
| 2,517,757 | 8/1950 | Adlerstein | 150/52 R UX |
| 3,477,552 | 11/1969 | Goldman | 190/2 |
| 3,818,962 | 6/1974 | Muller-Scherak | 190/2 X |

FOREIGN PATENTS OR APPLICATIONS

| | | | |
|---|---|---|---|
| 147,301 | 7/1952 | Australia | 150/1.7 |
| 738,091 | 10/1932 | France | 150/33 |
| 745,921 | 2/1933 | France | 150/1.7 |

*Primary Examiner*—Donald F. Norton
*Attorney, Agent, or Firm*—Phillips, Moore, Weissenberger, Lempio & Strabala

[57] ABSTRACT

A flat and flexible sheet of fabric has four zippers secured thereon with each of the zippers comprising a pair of tapes secured to the fabric and having a plurality of teeth disposed on an edge thereof. Each pair of tapes are disposed in perpendicular relationship relative to each other whereby movement of a slide for each zipper will connect the respective teeth together to form a tote bag comprising a bottom panel, a pair of side panels and a pair of end panels with each zipper thus connecting an edge of each side panel to an edge of a respective end panel. Carrying means in the form of a pair of closed loops, secured to an upper end of each of the side panels, are adapted to have a handle attached thereto for carrying purposes.

11 Claims, 5 Drawing Figures

CONVERTIBLE BLANKET ADAPTED TO FORM A TOTE BAG

BACKGROUND OF THE INVENTION

This invention relates to a blanket which is constructed and arranged to be formed into a tote bag or the like. A blanket is normally carried to a beach or picnic ground in a tote bag along with foodstuffs and sundry articles. Such a blanket is bulky and thus takes up an appreciable amount of space in the bag to restrict its ability to carry other items.

SUMMARY OF THIS INVENTION

An object of this invention is to provide a non-complex and economical convertible blanket which is adapted to be expeditiously formed into a receptacle, such as a tote bag. The blanket comprises a generally flat and flexible sheet of material defining a bottom panel, a pair of first and second side panels and a pair of first and second end panels. Closure means are secured on one side of the material to permit such panels to be folded and connected together to form such receptacle. In the preferred embodiment of this invention, such closure means comprises four zippers or the like and carrying means in the form of a plurality of closed loops are secured to upper ends of the side panels to provide means for attaching handles thereto when the blanket is formed into a receptacle.

BRIEF DESCRIPTION OF THE DRAWINGS

Other objects of this invention will become apparent from the following description and accompanying drawings wherein.

DETAILED DESCRIPTION

Figure 1:
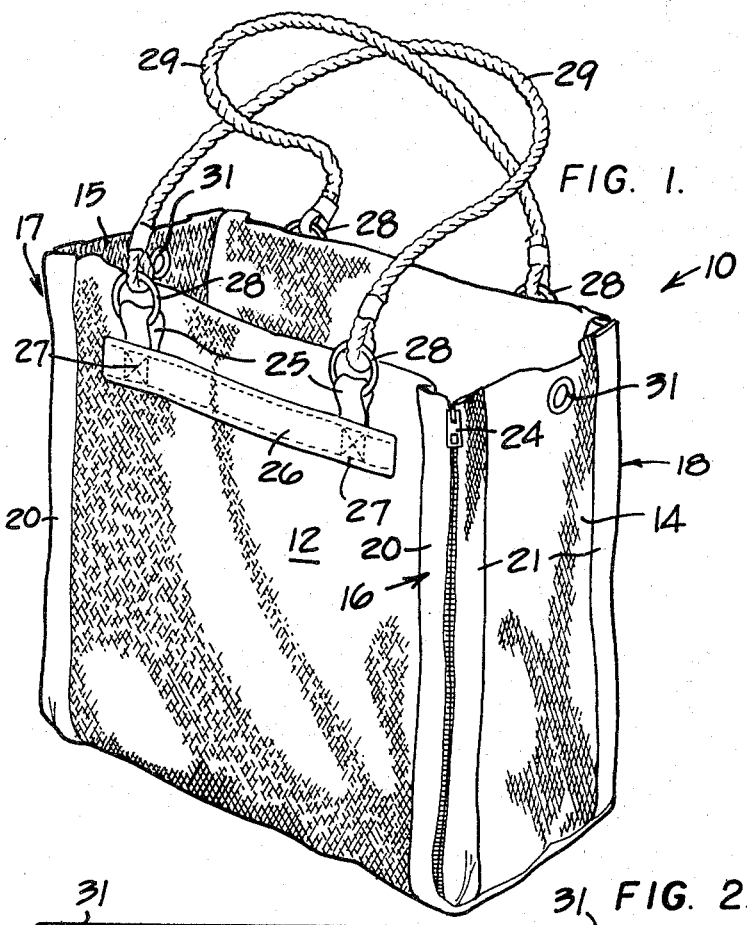
FIG. 1 is an isometric view of the tote bag embodying this invention.
Figure 2:
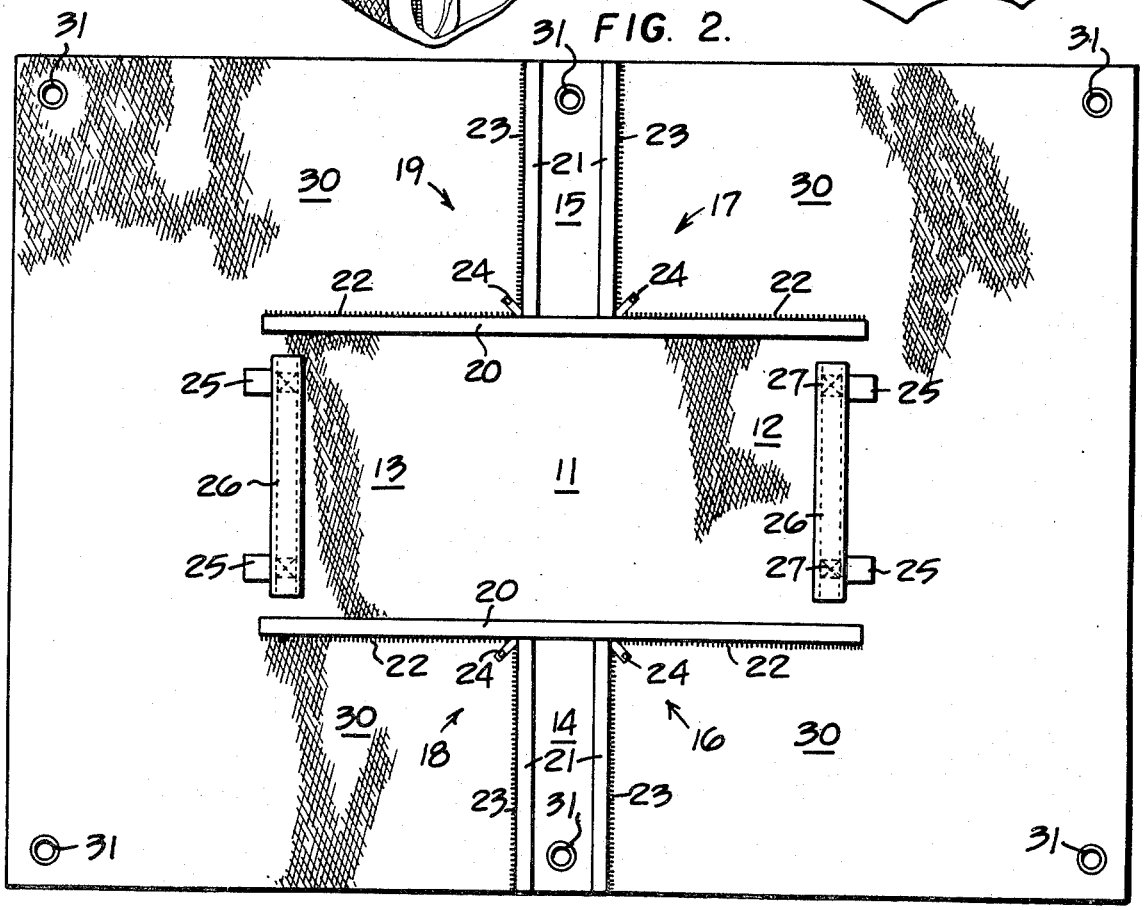
FIG. 2 is a top plan view of a convertible blanket adapted to be formed into the tote bag illustrated in FIG. 1.

FIG. 1 illustrates a receptacle 10, such as a tote bag, adapted to be formed from the flat and flexible sheet of fabric material illustrated in FIG. 2. Such fabric material is preferably suitably treated to render it semi-stiff, such as a heavy-duty denim material, to permit the tote bag to stand upright of its own accord in its FIG. 1 disposition. The blanket comprises a bottom panel 11, a first side panel 12, a second side panel 13, a first end panel 14 and a second end panel 15.

First, second, third and fourth closure means 16–19, respectively, are secured on one side of the blanket to selectively form the panels into the tote bag. Each of the closure means preferably constitutes a zipper comprising a pair of cloth tapes 20 and 21 disposed in perpendicular relationship relative to each other and each having first and second sets of zipper teeth or connecting means 22 and 23 formed on the free edges thereof. A standard slide 24 is adapted to be moved diagonally between the tapes to couple the teeth of each closure means together. It should be understood that other suitable types of closure means could be employed in lieu of the zippers, such as "VELCRO" fasteners, buttons and button holes, or conventional plastic-type zippers wherein a pair of non-toothed beaded edges are coupled together by a slide.

It should be noted that tapes 20 are disposed in laterally spaced and parallel relationship relative to each other whereas tapes 21 of closure means 16 and 18 as well as tapes 21 of closure means 17 and 19 are also disposed in parallel relationship relative to each other to define end panels 14 and 15, respectively. Thus, when each slide is moved diagonally away from the point of intersection of a respective pair of tapes 20 and 21, an edge of a side panel will be connected to an edge of an end panel. In particular, closure means 16 functions to connect the edges of panels 12 and 14 together, closure means 17 connects the edges of panels 12 and 15 together, closure means 18 connects the edges of panels 13 and 14 together and closure means 19 connects the edges of panels 13 and 15 together.

Figure 3:
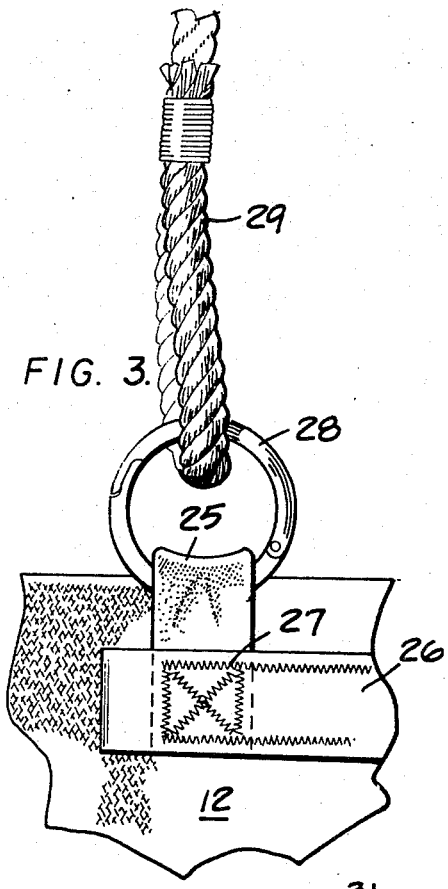
FIG. 3 is an enlarged view of carrying means attached to the blanket and adapted to have a handle attached thereto.

Carrying means, preferably in the form of a pair of loops 25, are secured to an upper end of each side panel 12 and 13 by a tape 26 and stitchings 27. The loops are laterally spaced on each side panel and each loop is adapted to receive a releasable snap ring 28 therein (FIG. 3). The snap ring is adapted to be opened to permit the mounting of a looped end of a handle 29 therein to facilitate carrying of the FIG. 1 tote bag.

Figure 4:
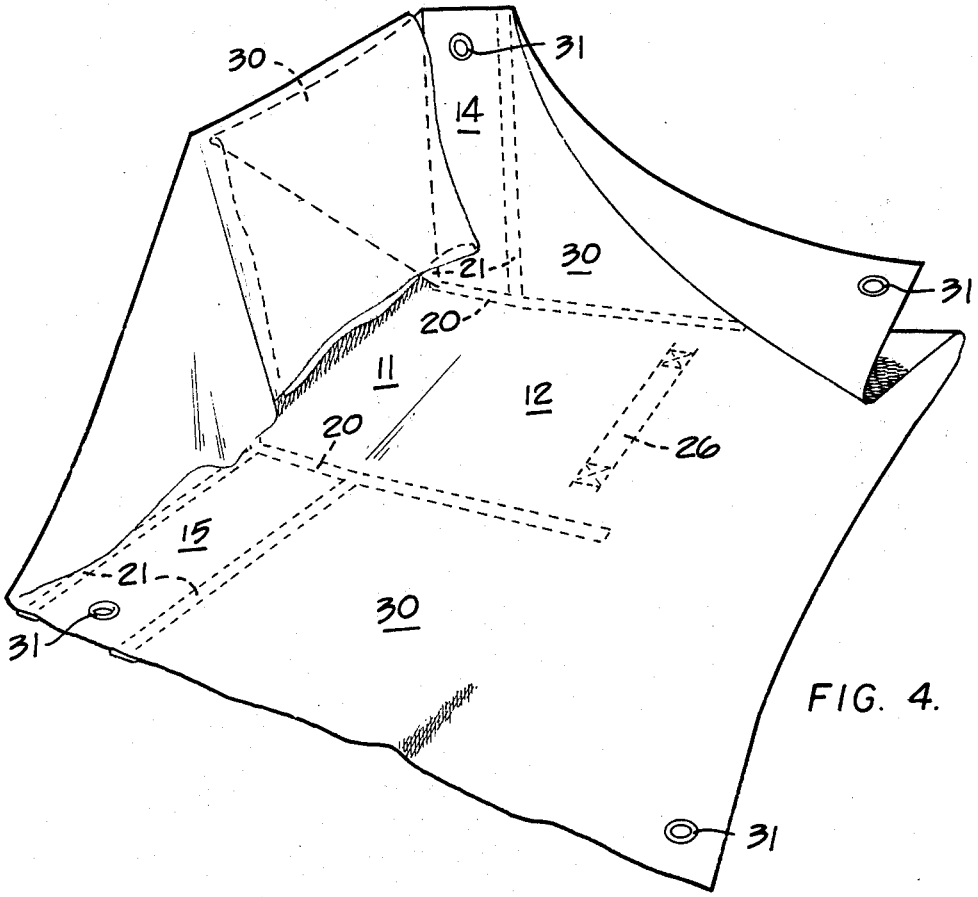
FIGS. 4 and 5 sequentially illustrate the folding and connecting together of various panels of the blanket during formation thereof into the FIG. 1 tote bag.
Figure 5:
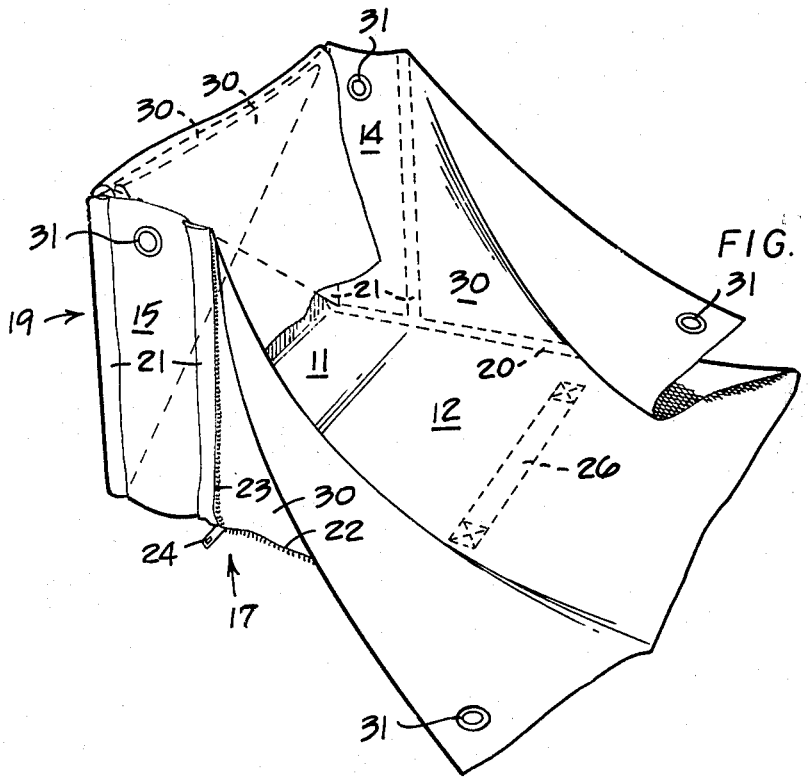

FIGS. 4 and 5 illustrate sequential steps during the formation of the FIG. 2 blanket into the tote bag illustrated in FIG. 1. It should be noted that the excess fabric disposed outside of tapes 20, 21 and 26 may be suitably folded and placed within the tote bag to form a liner therein. In fact, a separate pocket or gusset fold is formed at each corner of the bag from a web 30 of material disposed between each pair of tapes 20 and 21 for a respective closure means.

Upon carrying of the tote bag to a beach or the like, handle 29 may be suitably removed therefrom by unsnapping rings 28 and the zippers unzipped to reform the tote bag into the FIG. 2 flattened blanket condition. If so desired, a plurality of suitably disposed holes each reinforced by a grommet 31, can be formed through the blanket to adapt them for connection to handle 29, a rope or draw string (not shown) or other suitable carrying means.

I claim:

1. A convertible blanket adapted to be formed into a receptacle comprising a generally flat and flexible sheet of rectangular and substantially uninterrupted material defining a bottom panel, a pair of first and second side panels and a pair of first and second end panels with said bottom panel being common to each of said side and end panels, and closure means secured on only one side of said sheet of material in non-penetrating relationship thereto for selectively forming said panels into a receptacle.

2. The convertible blanket of claim 1 wherein said closure means comprises first closure means for connecting a first edge of said first side panel to a first edge of said first end panel, second closure means for connecting a second edge of said first side panel to a first edge of said second end panel, third closure means for connecting a first edge of said second panel to a second edge of said first end panel and fourth closure means for connecting a second edge of said second side panel to a second edge of said second end panel.

3. The convertible blanket of claim 2 wherein each of said first, second, third and fourth closure means comprises a first connecting means and a second connecting means disposed substantially perpendicular relative to said first connecting means.

4. The convertible blanket of claim 3 wherein each of said first and second connecting means is straight and wherein each respective pair of said first and second connecting means intersect at inner ends thereof, inwardly of said sheet material at a respective corner of said bottom panel.

5. The convertible blanket of claim 4 wherein the first connecting means of each of said first and third closure means are disposed in linear relationship relative to each other and wherein the first connecting means of each of said second and fourth closure means are disposed in linear relationship relative to each other and in parallel relationship relative to the first connecting means of said first and third closure means.

6. The convertible blanket of claim 5 wherein the second connecting means of each of said first and third closure means are disposed in parallel relationship relative to each other and wherein the second connecting means of each of said second and fourth closure means are disposed in parallel relationship relative to each other.

7. The convertible blanket of claim 2 wherein each of said closure means comprises a zipper comprising a pair of tapes secured in perpendicular relationship on said one side of said sheet, zipper teeth formed on a free edge of each of said tapes and intersecting the zipper teeth formed on the free edge of the other of said pair of tapes and a slide coupling the zipper teeth of said pair of zipper teeth together and normally disposed at the intersection thereof when said blanket is flat.

8. The convertible blanket of claim 1 further comprising carrying means secured to an upper end of each of said side panels adapted to have a handle attached thereto.

9. The convertible blanket of claim 8 wherein each of said carrying means comprises a pair of laterally spaced loops secured to a respective one of said side panels.

10. The convertible blanket of claim 9 further comprising a handle releasably attached to each pair of said loops.

11. The convertible blanket of claim 1 further comprising a plurality of apertures formed through said material adapted to have carrying means inserted therethrough.

* * * * *